US008845066B2

(12) United States Patent
Domae

(10) Patent No.: US 8,845,066 B2
(45) Date of Patent: Sep. 30, 2014

(54) INKJET PRINTER

(75) Inventor: Yoshinori Domae, Chiba (JP)

(73) Assignee: Seiko I Infotech Inc. (JP)

( * ) Notice: Subject to any disclaimer, the term of this patent is extended or adjusted under 35 U.S.C. 154(b) by 0 days.

(21) Appl. No.: 13/985,581

(22) PCT Filed: Oct. 28, 2011

(86) PCT No.: PCT/JP2011/074896

§ 371 (c)(1),
(2), (4) Date: Aug. 15, 2013

(87) PCT Pub. No.: WO2012/117611

PCT Pub. Date: Sep. 7, 2012

(65) Prior Publication Data

US 2013/0328963 A1 Dec. 12, 2013

(30) Foreign Application Priority Data

Mar. 1, 2011 (JP) ..... 2011-044295

(51) Int. Cl.
*B41J 29/377* (2006.01)

(52) U.S. Cl.
CPC ..... *B41J 29/377* (2013.01)
USPC ..... 347/18; 347/102

(58) Field of Classification Search
CPC .... B41J 29/377; B41J 11/002; B41J 2202/08; B41M 7/0081
USPC ..... 347/5, 17, 18, 19, 102
See application file for complete search history.

(56) References Cited

U.S. PATENT DOCUMENTS

| | | | | |
|---|---|---|---|---|
| 6,439,712 | B1 * | 8/2002 | Mizutani et al. | 347/102 |
| 6,714,229 | B2 * | 3/2004 | Miyazaki et al. | 347/223 |
| 2011/0050824 | A1 * | 3/2011 | Toya et al. | 347/102 |
| 2011/0199448 | A1 * | 8/2011 | Kaiho et al. | 347/102 |

FOREIGN PATENT DOCUMENTS

| | | | |
|---|---|---|---|
| JP | 2003-316237 | * 11/2003 | B41J 29/377 |
| JP | 2006-264328 | * 10/2006 | B41J 2/01 |

* cited by examiner

*Primary Examiner* — Huan Tran
(74) *Attorney, Agent, or Firm* — Adams & Wilks

(57) ABSTRACT

An inkjet printer has an ink jet head mounted on a carriage for ejecting ink onto a recording medium. A heater is arranged in the casing and above the ink jet head for heating the ejected ink. A first intake fan is mounted on the casing for feeding outside air into the casing. A second intake fan is mounted on the carriage for taking the fed outside air directly into the carriage so that the temperature inside the carriage can be set close to the temperature of the outside air to enable stable ejection of ink. Air fed into the casing is discharged to the outside through an exhaust duct passing through the casing and disposed at a position spaced from the print surface of the recording medium to prevent a decrease in temperature of the recording medium and ejection failure of the ink.

20 Claims, 3 Drawing Sheets

INKJET PRINTER

BRIEF SUMMARY OF THE INVENTION

1. TECHNICAL FIELD

The present invention relates to an inkjet printer.

2. BACKGROUND ART

There is known an inkjet printer for recording an image or the like by ejecting ink onto a recording medium such as recording paper and a resin film. In the inkjet printer, various kinds of ink are used. For example, solvent ink using an organic solvent as a primary solvent, ultraviolet curable ink, heat curable ink, and other various kinds of ink are used depending on applications. For example, JP 2006-264328 A discloses an inkjet printer using heat curable ink prepared so that fixing thereof is promoted by heat. In this apparatus, a heater is arranged above a carriage to extend along a scanning direction of the carriage.

CITATION LIST

Patent Literature

[PTL 1] JP 2006-264328 A

The conventional technology provides a system in which heat is applied to the ink and the recording medium immediately after the ink is ejected from an ink jet head, to thereby dry the ink efficiently. In this case, the heater is arranged immediately above the ink jet head. In such a configuration, the carriage including the inkjet head is heated immediately below the heater, and hence the temperature of the ink jet head rises, resulting in ejection failure. Therefore, in the conventional technology, cooling fans are arranged in parallel to the heater, and air is blown into the carriage to cool the carriage. Further, a windshield is provided to the carriage so that the air is easily blown into the carriage. The cooling fans provided at both ends in the scanning direction of the carriage are configured so that the air flows from the inside to the outside, and thus the air flows from the center side toward both the ends. Further, JP 2006-264328 A discloses technologies for preventing temperature rise of the carriage, such as a system for cooling the carriage with cooling water and a configuration in which a heat resistant plate for reflecting light is arranged on an upper portion of the carriage.

However, there are problems in that an excessive space is necessary and cost increases in the case of using the cooling water, the heat resistant plate, and the like.

Further, the fans are mounted above the carriage in the direction toward the recording medium, and hence there is also a problem in that the air is blown also to the recording medium immediately before and after the printing and therefore the recording medium is cooled. When the outside air is actively introduced in a direction toward the carriage, the following problems arise. That is, the temperature of the recording medium is dropped, and hence the ink landing on the recording medium causes fixing failure. Further, the air is led to a nozzle surface of the ink jet head, and hence ejection failure occurs.

SUMMARY OF THE INVENTION

To cope with the above-mentioned problems, according to the present invention, there is provided an inkjet printer, including: ink to be fixed onto a recording medium, the ink being prepared so that drying thereof is promoted by heat; an ink jet head for ejecting the ink onto the recording medium; a carriage having the ink jet head mounted thereto, the carriage being configured to reciprocate in a scanning manner in a direction crossing a conveyance direction of the recording medium; a platen arranged to be opposed to a bottom surface side of the carriage, the platen being configured to hold the recording medium; and a heater arranged above the carriage, the heater being configured to heat the ink landing on the recording medium, the heater being arranged inside a casing, the inkjet printer being configured to fix the ink onto the recording medium by heating the ink immediately after landing on the recording medium, the inkjet printer further including: an exterior opening portion for air intake, which is arranged in a rear surface of the casing, and is configured to take an outside gas into the casing therethrough; an intake fan for an apparatus interior, which is provided to the exterior opening portion, and is configured to feed air into the casing; a rear surface opening portion provided at a position on the carriage, which is opposed to the exterior opening portion; an exhaust opening portion for air exhaust from inside the carriage, the exhaust opening portion being arranged to be oriented toward a downstream side of the carriage in the conveyance direction of the recording medium; an exhaust duct including a duct intake opening portion for air intake, which is provided inside the casing, the exhaust duct passing through the casing at a position on an opposite side to the recording medium across the heater, the exhaust duct further including a duct exhaust opening portion provided to the casing at a position on a delivery side of the recording medium, the duct exhaust opening portion being configured to exhaust the air toward an outside of the casing therethrough; and a duct exhaust fan provided to the duct exhaust opening portion, the duct exhaust fan being configured to discharge a gas from inside the exhaust duct to the outside.

The outside air taken into the apparatus directly enters the carriage, to thereby prevent the rise in temperature inside the carriage. The outside air that is not taken into the carriage is taken into the exhaust duct extending through the upper portion of the apparatus, and is discharged to the outside. Thus, the air at the temperature of the outside air is not led onto the recording medium, to thereby prevent the temperature drop of the ink immediately after the landing. At the same time, the amount of air that is led to the nozzle surface of the head is significantly small, to thereby prevent various problems inherent in the head, such as reduction in landing accuracy of the ink, increase of ink mist, and drying of the nozzle.

DETAILED DESCRIPTION OF THE INVENTION

An embodiment of the present invention is described with reference to the drawings.

Figure 1:
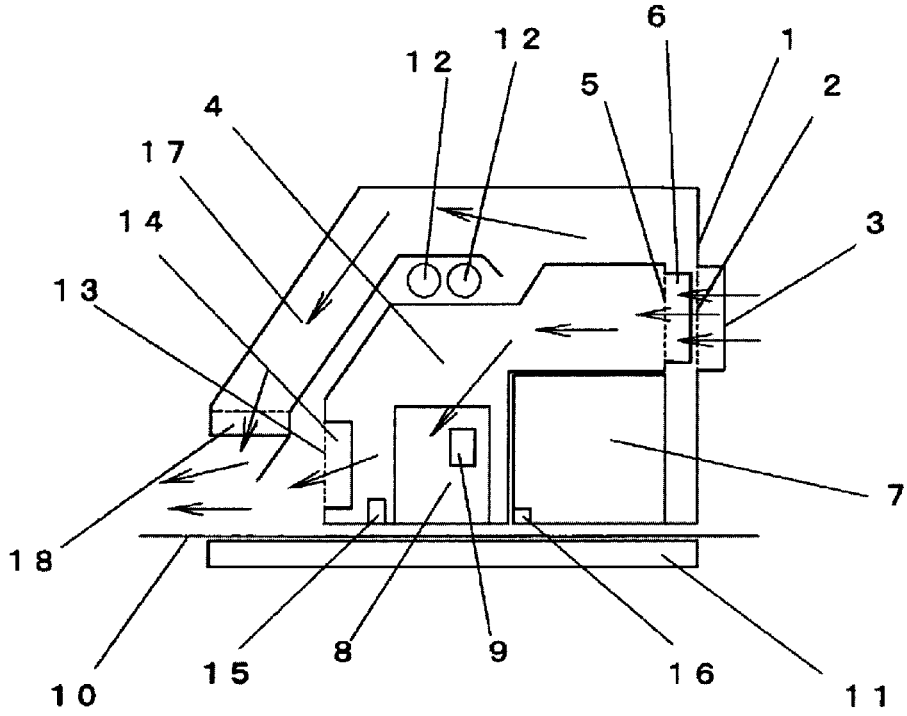
FIG. 1 is a schematic sectional side view illustrating a first gas flow inside an inkjet printer according to an embodiment of the present invention.

FIG. 1 is a schematic sectional side view illustrating an inkjet printer. The arrows indicate a gas flowing direction. An intake opening portion 2 is formed in a rear surface of an apparatus exterior 1, and an intake fan 3 (first intake fan) for an apparatus interior is mounted thereto. A rear surface of a carriage 4 is located in proximity to the rear surface of the apparatus exterior 1 serving as a casing of the inkjet printer, and a carriage intake fan 6 (second intake fan) is mounted to an intake opening portion 5 formed in the rear surface of the carriage 4. The intake fan 3 for an apparatus interior is arranged at a position opposed to the carriage intake fan 6 so as to cover the entire region in a moving direction of the carriage 4. The intake fan 3 for an apparatus interior is arranged without an intermediation of an obstacle, and hence, immediately after the intake fan 3 for an apparatus interior takes outside air into the apparatus, the carriage intake fan 6 may take the air into the carriage 4. The carriage 4 is mounted to a Y-rail 7, and is movable in a scanning direction. The Y-rail 7 is a rail for guiding the carriage 4 in the moving direction thereof. An ink jet head 8 is mounted inside the carriage 4, and a nozzle surface for ejecting ink is located so as to be exposed from a bottom surface of the carriage 4. An ink temperature sensor 9 for determining the temperature of an ink flow path is mounted to the ink jet head 8, and further, an ink heater for heating the ink in the ink flow path is built into the ink jet head 8.

A platen 11 formed of a flat plate is provided to the casing at a position on the bottom surface side of the carriage 4. A recording medium 10 such as recording paper and a resin film is conveyed by a conveyance apparatus (not shown) so as to be guided onto the platen 11. The inkjet head 8 ejects the ink onto the recording medium 10 that is held on the platen 11, to thereby form an image. The platen 11 may have a suction hole to hold the recording medium 10.

Heaters 12 are mounted immediately above the carriage 4, that is, on a top surface side of the casing. Heaters 12 rapidly heat the ink ejected from the ink jet head 8. A sheathed heater, a carbon heater, or the like is used as each of the heaters 12. Considering a distance from the heaters 12 to the recording medium 10, it is preferred that the ink be heated through infrared-ray irradiation instead of heating the ink through thermal conduction. Thus, it is preferred that each of the heaters 12 be a heater that radiates a large amount of infrared rays. For example, it is preferred to use a ceramic heater, a carbon heater, and a sheathed heater subjected to surface treatment so as to facilitate emission of the infrared rays.

A given period of time is necessary from the time when the power of the heaters 12 is turned ON until the temperature thereof reaches a desired temperature. Therefore, it is necessary to turn ON the power before ejecting the ink. That is, when the apparatus is in use, the power of the heaters 12 is mostly turned ON, and the portion around the heaters 12 is heated. An opening portion 13 is formed in the front of the carriage 4, that is, on a delivery side of the recording medium 10, and the air inside the carriage is exhausted by a carriage exhaust fan 14 (second exhaust fan). Thus, the air taken into the carriage 4 by the carriage intake fan 6 passes through the vicinity of the ink jet head 8 inside the carriage 4, and is exhausted toward the front of the carriage 4 by the carriage exhaust fan 14 so that the portion around the ink jet head 8 may also be set at a temperature close to the temperature of the outside air. The carriage 4 has a box-like shape with the opening portion 5 in the rear and the opening portion 13 in the front, and hence the gas inside the carriage 4 flows from the opening portion 5 in the rear to the opening portion 13 in the front.

Still further, even in a case where the carriage exhaust fan 14 is omitted as an example of improvement toward a simpler configuration, the pressure of the gas inside the carriage 4 is increased by the carriage intake fan 6, and hence the gas is exhausted through the opening portion 13 located in the front of the carriage 4. However, as compared to the case of using the carriage exhaust fan 14, the air flow rate is decreased, resulting in a small exhaust amount.

Inside the carriage 4, a carriage temperature sensor 15 is arranged at a position in the vicinity of the ink jet head 8, to thereby confirm whether or not the temperature inside the carriage 4 is a temperature appropriate to the ink jet head 8. Also inside the apparatus, an internal temperature sensor 16 is arranged at a position in the vicinity of the carriage 4, to thereby confirm whether or not the internal temperature is appropriate. An exhaust duct 17 is provided on the front side of the apparatus, and a duct exhaust fan 18 (first exhaust fan) is mounted so as to take, into the exhaust duct 17, the gas that is taken into the apparatus through the intake fan 3 for an apparatus interior, which is located on the rear surface of the apparatus, and to discharge the gas thus taken in. Therefore, at a location at which the carriage 4 is not provided, the gas taken into the casing is mainly taken into the exhaust duct 17, thereby being capable of reducing the amount of the gas flowing toward the ink jet head 8, and preventing fluctuation of an ejection direction, which is caused by the air flow, and a temperature drop of the recording medium 10. A part of the exhaust duct 17 is located so as to cover an upper portion of the heaters 12, to thereby serve also as a reflection plate for the infrared rays radiated from the heaters 12. As a result, the ink may be heated more efficiently. It is preferred that the exhaust duct 17 be made of a metal to have a gloss thereon or a gloss or white layer be formed on a surface of the exhaust duct 17, to thereby increase the surface reflectance. A discharge direction of the air to be exhausted by the duct exhaust fan 18 may correspond to a conveyance direction of the recording medium 10, or may correspond to a direction toward the recording medium 10 when the drying of the ink is to be promoted. When the air is exhausted in the conveyance direction of the recording medium 10, the exhausted gas triggers the gas, which is exhausted by the carriage exhaust fan 14, to be discharged actively outside the apparatus. In order to blow the air toward the outside, the blowing direction of the gas to be exhausted by the duct exhaust fan 18 is preferred to be inclined in the delivery direction of the recording medium within a range of 0° or more and less than 90° with respect to a surface of the recording medium 10. With this configuration, the temperature management for the ink jet head 8 is facilitated, and at the same time, the air may be taken into the apparatus and exhausted outside the apparatus without causing significant turbulence of the air flow in the vicinity of the nozzle surface. As a result, the problems such as the increase of ink mist and the drying of the nozzle are prevented so that the printing stability may be enhanced.

The gas flows from the rear surface of the inkjet printer in the direction toward the front surface, thereby preventing the gas from flowing toward the ejection surface of the ink jet head 8.

Figure 2:
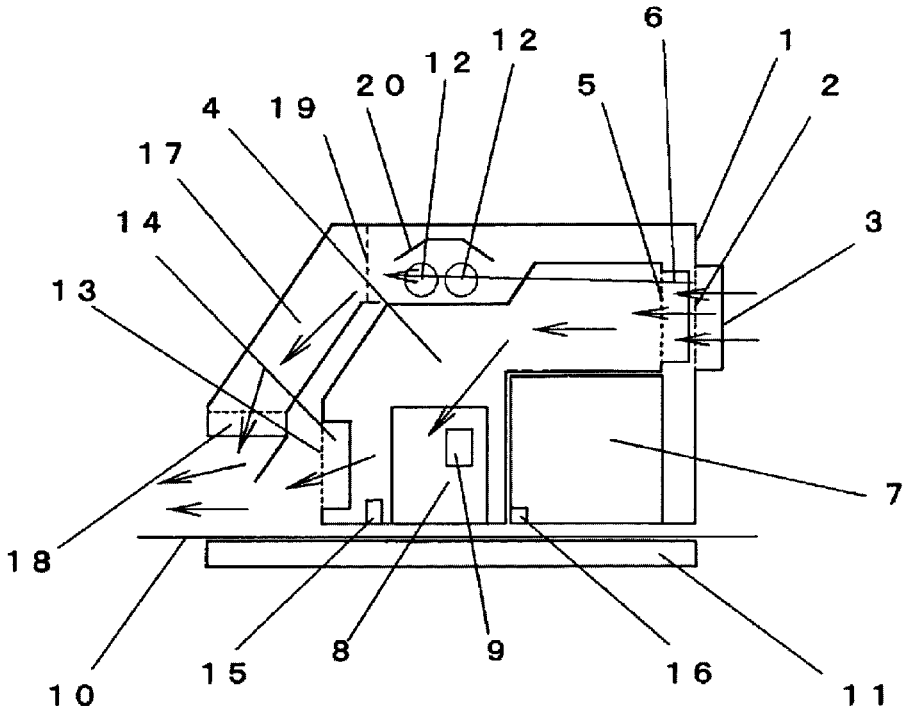
FIG. 2 is a schematic sectional side view illustrating a second gas flow inside the inkjet printer according to the embodiment of the present invention.

FIG. 2 is another example of the schematic sectional side view illustrating the inkjet printer. The arrows indicate a gas flowing direction. The configuration of FIG. 2 is different from that of FIG. 1 in that an exhaust duct opening portion 19 is arranged in the vicinity of the heaters 12 at a position on a sheet delivery side, and that the gas in the vicinity of the heaters is taken into the exhaust duct 17. The heaters 12 are cooled through convection caused by the gas flow so that the deterioration of the heaters 12 maybe prevented. A reflector 20 is separately arranged above the heaters 12 so as to enhance the efficiency of the infrared-ray irradiation of the heaters 12. The reflector 20 may be formed of a flat plate, but the infrared rays may be condensed efficiently when the reflector 20 has an oval shape or a parabolic shape. The heated air in the vicinity of the heaters 12 is discharged to the recording medium 10 after the printing, and thus the fixing of the ink may further be promoted.

Figure 3:
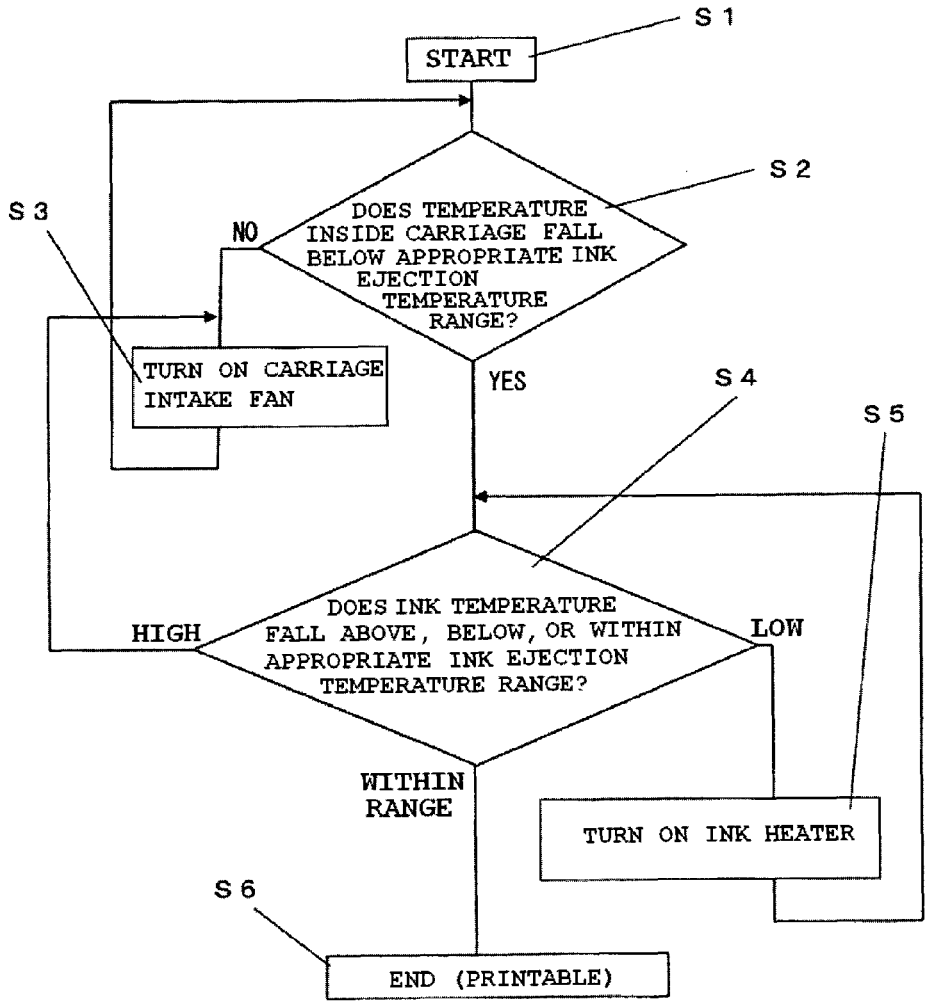
FIG. 3 is a flow chart illustrating temperature control for an ink jet head according to the embodiment of the present invention.

FIG. 3 is a flow chart illustrating temperature control for the ink jet head 8. An example of operations of the fans is described with reference to FIG. 3. Under an initial state of the apparatus, the heaters 12 above the carriage 4 are turned ON, and the intake fan 3 for an apparatus interior and the duct exhaust fan 18 are driven. The RPMs of both the fans are controlled so as to maintain the internal temperature to an appropriate temperature based on a detection value of the internal temperature sensor 16 arranged at the position close to the carriage 4. Thus, the balance between the air intake and the air exhaust is maintained. In this state, the temperature control for the ink jet head 8 is started (Step S1). Subsequently, the temperature sensor 15 inside the carriage is used to confirm whether or not the temperature inside the carriage falls within or below an appropriate ink ejection temperature range (Step S2). When the confirmation result indicates "NO", that is, when the temperature inside the carriage falls above the appropriate ink ejection temperature range, the carriage intake fan 6 is driven (Step S3) . It is preferred that the carriage intake fan 6 be controlled so as to gradually enhance the intake performance thereof . In order to take a larger amount of air into the carriage 4, it is preferred to perform, in association with the control for gradually enhancing the intake performance of the carriage intake fan 6, control for enhancing the intake performance of the intake fan 3 for an apparatus interior and control for enhancing the intake performance of the duct exhaust fan 18. As illustrated in FIGS. 1 and 2, the carriage 4 includes the opening portion 13 in the front, and the gas inside the carriage is exhausted through the opening portion 13. The carriage exhaust fan 14 is mounted at the opening portion 13, and is operated in synchronization with the carriage intake fan 6 so that the air may be exhausted forcibly. Returning to Step S2, it is confirmed whether or not the temperature inside the carriage is dropped to fall within or below the appropriate ink ejection temperature range. The outside air taken into the apparatus by the intake fan 3 for an apparatus interior is directly taken into the carriage 4 by the carriage intake fan 6, and hence the temperature inside the carriage may be dropped close to the temperature of the outside air. Subsequently, the ink temperature sensor 9 built into the ink jet head 8 is used to confirm whether or not the temperature of the ink falls above, below, or within the appropriate ink ejection temperature range (Step S4). When it is determined that the temperature falls above the appropriate ink ejection temperature range in Step S4, Steps S3 and S4 are repeated until the determination in Step S4 indicates that the temperature falls within the appropriate temperature range. When it is determined that the temperature falls below the appropriate ink ejection temperature range in Step S4, the ink heater built into the inkjet head 8 is used to heat the ink (Step S5). Steps S4 and S5 are repeated until the temperature read by the ink temperature sensor 9 falls within the appropriate range. When the determination in Step S4 indicates that the temperature falls within the appropriate temperature range, the ink may be ejected from the ink jet head 8 (Step S6). This sequential control is repeated so that stable printing may be performed.

Industrial Applicability

The present invention is applicable to an ink jet printer.

Reference Signs List

1 apparatus exterior
2 intake opening portion formed in rear surface of apparatus exterior
3 intake fan for apparatus interior
4 carriage
5 intake opening portion formed in rear surface of carriage
6 carriage intake fan
7 Y-rail
8 ink jet head
9 ink temperature sensor
10 recording medium
11 platen
12 heater
13 exhaust opening portion formed in front of carriage
14 carriage exhaust fan
15 carriage temperature sensor
16 internal temperature sensor
17 exhaust duct
18 duct exhaust fan
19 exhaust duct opening portion
20 reflector

The invention claimed is:

1. An inkjet printer for ejecting and fixing ink onto a recording medium, the inkjet printer comprising:

an ink jet head for ejecting the so as to land on the recording medium;

a carriage having the ink jet head mounted thereto, the carriage being configured to reciprocate in a scanning manner in a direction crossing a conveyance direction of the recording medium;

a platen arranged to be opposed to a bottom surface side of the carriage, the platen being configured to hold the recording medium, a heater arranged inside a casing and above the carriage, the heater being configured to heat the ink immediately after landing on the recording medium to thereby fix the ink onto the recording medium;

an exterior opening portion for air intake, the exterior opening portion being arranged in a rear surface of the casing and configured to take outside air into the casing;

a first intake fan provided to the exterior opening portion and configured to feed air into the casing via the exterior opening portion;

a rear surface opening portion provided on the carriage at a position opposed to the exterior opening portion;

an exhaust opening portion for air exhaust from inside the carriage, the exhaust opening portion being arranged to be oriented toward a downstream side of the carriage in the conveyance direction of the recording medium;

an exhaust duct provided inside of and passing through the casing at a position on an opposite side to the recording medium across the heater, the exhaust duct having a duct intake opening portion for air intake and a duct exhaust opening portion provided to the casing at a position on a delivery side of the recording medium, the duct exhaust opening portion being configured to exhaust the air toward an outside of the casing; and a duct exhaust fan provided to the duct exhaust opening portion of the exhaust duct, the duct exhaust fan being configured to discharge a gas from inside the exhaust duct to the outside of the casing.

2. An inkjet printer according to claim 1, further comprising a second intake fan provided to the rear surface opening portion, the second intake fan being configured to blow into the carriage the outside air fed into the casing by the first intake fan.

3. An inkjet printer according to claim 2, further comprising a carriage exhaust fan provided to the duct exhaust opening portion, the carriage exhaust fan being configured to exhaust to the outside the air blown into the carriage by the second intake fan.

4. An inkjet printer according to claim 1, wherein a surface of the exhaust duct opposite to the heater comprises a reflection layer for reflecting an infrared ray radiated from the heater.

5. An inkjet printer according to claim 1, wherein the duct exhaust fan is configured so that a blowing direction thereof is inclined in a delivery direction of the recording medium within a range of 0° or more and less than 90° with respect to a surface of the recording medium.

6. An inkjet printer according to claim 2, wherein the carriage has a first temperature sensor for measuring the temperature inside of the carriage; wherein the ink jet head has a second temperature sensor for measuring the temperature of an ink flow path; and wherein an operation of the second intake fan is controlled based on the temperature measured by the carriage temperature sensor and the temperature measured by the head temperature sensor.

7. An inkjet printer according to claim 6, wherein a surface of the exhaust duct opposite to the heater comprises a reflection layer for reflecting an infrared ray radiated from the heater.

8. An inkjet printer according to claim 7, wherein the duct exhaust fan is configured so that a blowing direction thereof is inclined in a delivery direction of the recording medium within a range of 0° or more and less than 90° with respect to a surface of the recording medium.

9. An inkjet printer according to claim 6, wherein the duct exhaust fan is configured so that a blowing direction thereof is inclined in a delivery direction of the recording medium within a range of 0° or more and less than 90° with respect to a surface of the recording medium.

10. An inkjet printer according to claim 2, wherein a surface of the exhaust duct opposite to the heater comprises a reflection layer for reflecting an infrared ray radiated from the heater.

11. An inkjet printer according to claim 10, wherein the duct exhaust fan is configured so that a blowing direction thereof is inclined in a delivery direction of the recording medium within a range of 0° or more and less than 90° with respect to a surface of the recording medium.

12. An inkjet printer according to claim 2, wherein the duct exhaust fan is configured so that a blowing direction thereof is inclined in a delivery direction of the recording medium within a range of 0° or more and less than 90° with respect to a surface of the recording medium.

13. An inkjet printer according to claim 3, wherein the carriage has a first temperature sensor for measuring the temperature inside of the carriage; wherein the ink jet head has a second temperature sensor for measuring the temperature of an ink flow path; and wherein an operation of the second intake fan is controlled based on the temperature measured by the carriage temperature sensor and the temperature measured by the head temperature sensor.

14. An inkjet printer according to claim 3, wherein a surface of the exhaust duct opposite to the heater comprises a reflection layer for reflecting an infrared ray radiated from the heater.

15. An inkjet printer according to claim 3, wherein the duct exhaust fan is configured so that a blowing direction thereof is inclined in a delivery direction of the recording medium within a range of 0° or more and less than 90° with respect to a surface of the recording medium.

16. An inkjet printer for printing on a print surface of a recording medium during a printing operation, the inkjet printer comprising:

a casing having an opening portion;

a carriage mounted relative to the casing for undergoing reciprocating movement in a direction crossing a conveyance direction of the recording medium, the carriage having an intake opening portion at a rear surface thereof for taking in outside air;

an ink jet head mounted on the carriage for ejecting ink onto the print surface of the recording medium during a printing operation;

a heater arranged inside of the casing and above the ink jet head for heating the ink ejected onto the recording medium by the ink jet head;

a first intake fan mounted on the casing for feeding air from outside of the casing into the casing via the opening portion thereof;

a second intake fan mounted on the carriage for taking outside air fed by the first intake fan directly into the carriage via the intake opening portion thereof so that the temperature inside of the carriage can be set close to the temperature of the outside air to enable stable ejection of ink by the ink jet head; and an exhaust duct passing through the casing and through which the air fed into the casing by the first intake fan is discharged to the outside, the exhaust duct being disposed at a position spaced from the print surface of the recording medium to thereby prevent the air discharged by the exhaust duct from decreasing the temperature of the recording medium and prevent ejection failure of the ink from the inkjet head.

17. An inkjet printer according to claim 16, wherein the heater comprises an infrared-ray radiation device for heating the ink through infrared-ray irradiation.

18. An inkjet printer according to claim 17, wherein a surface of the exhaust duct is located so as to cover an upper portion of the infrared-ray radiation device and comprises a reflection layer for reflecting an infrared ray radiated from the infrared-ray radiation device.

19. An inkjet printer according to claim 16, further comprising a duct exhaust fan for discharging the air in the exhaust duct to the outside, the duct exhaust fan being configured so that a blowing direction thereof is inclined in a delivery direction of the recording medium within a range of 0° or more and less than 90° with respect to a surface of the recording medium.

20. An inkjet printer according to claim 16, wherein the carriage has a first temperature sensor for measuring the temperature inside of the carriage; wherein the ink jet head has a second temperature sensor for measuring the temperature of an ink flow path; and wherein an operation of the second intake fan is controlled based on the temperature measured by the carriage temperature sensor and the temperature measured by the head temperature sensor.

* * * * *